United States Patent [19]

Plewes

[11] 4,260,432

[45] Apr. 7, 1981

[54] METHOD FOR PRODUCING COPPER BASED SPINODAL ALLOYS

[75] Inventor: John T. Plewes, Berkeley Heights, N.J.

[73] Assignee: Bell Telephone Laboratories, Incorporated, Murray Hill, N.J.

[21] Appl. No.: 6,616

[22] Filed: Jan. 10, 1979

Related U.S. Application Data

[63] Continuation of Ser. No. 838,141, Sep. 30, 1977, abandoned.

[51] Int. Cl.[3] ..... C22F 1/08

[52] U.S. Cl. ..... 148/2; 148/3; 148/12.7 C; 148/32.5; 148/160

[58] Field of Search ..... 148/32, 32.5, 2, 3, 148/12.7 C, 160

[56] References Cited

U.S. PATENT DOCUMENTS

| | | | |
|---|---|---|---|
| 4,052,204 | 10/1977 | Plewes | 148/160 |
| 4,073,667 | 2/1978 | Caron et al. | 148/12.7 C |

*Primary Examiner*—R. Dean

*Attorney, Agent, or Firm*—Peter A. Businger; Peter V. D. Wilde

[57] ABSTRACT

Alloys are disclosed which contain Cu, Ni, Sn, and prescribed amounts of Mo, Nb, Ta, V, or Fe. A predominantly spinodal structure is developed in such alloys by a treatment which requires annealing, quenching, and aging, and which does not require cold working to develop alloy properties. The shape of articles made from such alloys may be as cast, forged, extruded, hot worked, hot pressed, or cold worked. Shaped articles are strong, ductile, and have isotropic formability.

8 Claims, 2 Drawing Figures

METHOD FOR PRODUCING COPPER BASED SPINODAL ALLOYS

CROSS-REFERENCE TO RELATED APPLICATIONS

This application is a continuation of application Ser. No. 838,141, filed Sept. 30, 1977, abandoned.

BACKGROUND OF THE INVENTION

1. Field of the Invention

The invention is concerned with copper based alloys.

2. Description of the Prior Art

Alloys containing copper, nickel, and tin have been proposed as economical substitutes for copper-beryllium and phosphor-bronze alloys in the manufacture of shaped articles such as wire, wire connectors, springs, and relay elements. Among alloy properties on which such use is based are high strength, good formability, corrosion resistance, solderability, and electrical conductivity. Cu-Ni-Sn alloys exhibiting desirable combinations of properties are disclosed in U.S. Pat. No. 3,937,638, U.S. Pat. No. 4,052,204, and U.S. Pat. No. 4,090,890, all in the name of J. T. Plewes.

U.S. Pat. No. 3,937,638 discloses a treatment of a Cu-Ni-Sn cast ingot which involves homogenizing, cold working, and aging and which leads to a predominantly spinodal structure in the treated alloy. For example, in the case of an alloy containing seven percent Ni, eight percent Sn, and remainder copper, an exemplary method calls for homogenizing the cast ingot, cold working to achieve 99 percent area reduction, and aging for eight seconds at a temperature of 425 degrees C. The resulting article has 0.01 percent yield strength of 173,000 psi and ductility of 47 percent area reduction to fracture.

U.S. Pat. No. 4,052,204 discloses quaternary alloys containing not only Cu, Ni, and Sn, but also at least one additional element selected from among the elements Fe, Zn, Mn, Zr, Nb, Cr, Al, and Mg. A predominantly spinodal structure is produced in these alloys by a treatment of homogenizing, cold working, and aging analogous to the treatment disclosed in U.S. Pat. No. 3,937,638.

U.S. Pat. No. 4,090,890, discloses cold rolled and aged strip material made of alloys having a composition similar to the composition of alloys disclosed in U.S. Pat. No. 3,937,638 and U.S. Pat. No. 4,052,204 and having not only high strength, but also essentially isotropic formability. As a consequence, such strip material is particularly suited for the manufacture of articles which require bending of the strip in directions having a substantial component perpendicular to the rolling direction.

Cu-Ni-Sn alloys and their properties are a subject also of the following papers: L. H. Schwartz, S. Mahajan, and J. T. Plewes, "Spinodal Decomposition in a Cu-9 wt% Ni-6 Sn Alloy", *Acta Metallurgica, Vol.* 22, May 1974, pp. 601-609; L. H. Schwartz and J. T. Plewes, "Spinodal Decomposition in Cu-9wt% Ni-6wt% Sn-II. A Critical Examination of Mechanical Strength of Spinodal Alloys", *Acta Metallurgica,* Vol. 22, July 1974, pp. 911-921; John T. Plewes, "Spinodal Cu-Ni-Sn alloys are Strong and Superductile", *Metal Progress,* July 1974, pp. 46-50; J. T. Plewes, "High-Strength Cu-Ni-Sn alloys by Thermomechanical Processing", Metallurgical Transactions A, Vol. 6A, March 1975, pp. 537-544.

The achievement of good strength and bend properties in copper based alloys containing Ni and Sn is an object also of the method disclosed in U.S. Pat. No. 3,941,620, M. J. Pryor et al., "Method of Processing Copper Base Alloys". Pryor discloses a method for treating an ingot by homogenizing, cold rolling, aging, and again cold rolling.

SUMMARY OF THE INVENTION

It has been discovered that in copper based alloys containing from 3-30 weight percent Ni, from 3.5-10 weight percent Sn at 3 percent Ni and from 3.5-12 weight percent Sn at 20 percent Ni, an element selected from the group consisting of Mo, Nb, Ta, V, and Fe, and remainder essentially copper, a predominantly spinodal structure can be developed by a treatment of annealing, quenching, and aging. Since the treatment does not require cold deformation, such alloys are equally suited for the manufacture of articles by hot working, cold working, casting, forging, extruding, hot pressing, or cold working. Resulting articles are strong, ductile, and have isotropic formability.

DETAILED DESCRIPTION

Figure 1:
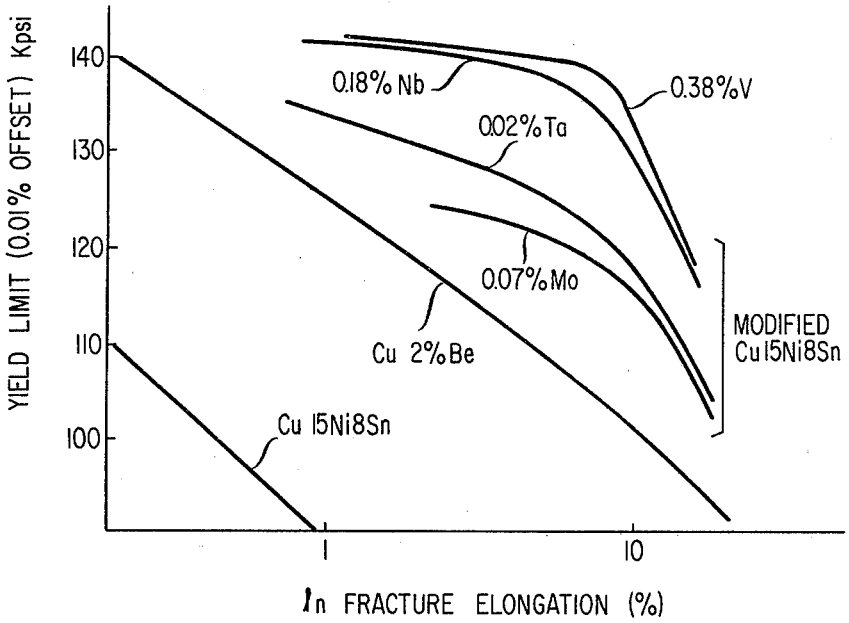
FIG. 1 is a diagram which shows combinations of yield strength and fracture elongation realized in two prior art alloys and four alloys of the invention.

FIG. 1 shows curves corresponding to prior art alloys Cu—15 percent Ni—8 percent Sn and Cu—2 percent Be, and new alloys Cu—15 percent Ni—8 percent Sn—0.07 percent Mo, Cu—15 percent Ni—8 percent Sn—0.02 percent Ta, Cu—15 percent Ni—8 percent Sn—0.18 percent Nb, and Cu—15 percent Ni—8 percent Sn—0.38 percent V. Cu-Be alloy is as commercially available. Cu-Ni-Sn alloys have been annealed at 825 degrees C. for one hour, water quenched, and aged at 400 degrees C. by varying amounts, longer aging times corresponding to higher levels of yield strength and shorter aging times corresponding to higher levels of fracture elongation. FIG. 1 illustrates the superior strength and ductility of the new alloys as compared with prior art alloys.

Figure 2:
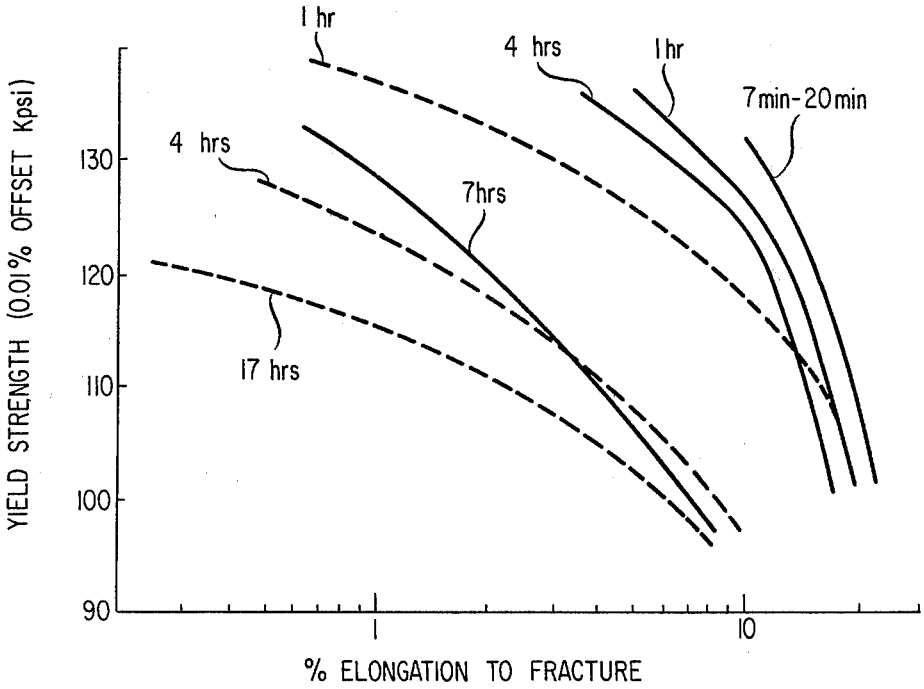
FIG. 2 is a diagram which shows combinations of yield strength and elongation of a Cu-15Ni-8Sn-0.2Nb alloy which was annealed and aged by various amounts.

FIG. 2 shows properties of 0.03" wire of a Cu—15 percent Ni—8 percent Sn—0.2 percent Nb alloy. Solid curves correspond to properties of a wire which was annealed at a temperature of 825 degrees C. for periods of from 7-20 minutes, 1 hour, 4 hours, and 17 hours, followed by quenching and aging at 400 degrees C. for 1 hour. Dashed curves correspond to properties of a wire which was annealed at 900 degrees C. for periods of 1 hour, 4 hours, and 17 hours, followed by quenching and aging at 400 degrees C. for 1 hour. FIG. 2 illustrates the influence of anneal temperature on ultimate properties of the alloy and, for fixed anneal temperature, the influence of anneal time on such properties. Apparent, in view of FIG. 2, is the desirability of short anneal times and low anneal temperatures.

Alloys of the invention contain 3-20 weight percent Ni, 3.5-10 weight percent Sn at 3 percent Ni and 3.5-12 weight percent Sn at 20 percent Ni. Limits on Sn contents for intermediary levels of Ni may be obtained by linear interpolation between limits at 3 percent and 20 percent Ni.

While the preparation of a melt of a Cu-Ni-Sn-Fe alloy of the invention may proceed by customary metallurgical practice, special care is required in the preparation of melts containing refractory elements Mo, Nb, Ta, or V.

Preparation of such latter melts may proceed, for example, as follows. Cu and Ni or a Cu-Ni alloy are melted in air at a temperature in the vicinity of 1300 degrees C. resulting in a melt high in oxygen and low in hydrogen contents. To reduce oxygen contents a cover of dry graphite chips is placed on the melt. Simultaneously, an inert gas such as argon is bubbled through the melt for a period of about one-half hour to prevent hydrogen contents of the melt from increasing. Sn is added while bubbling of the inert gas is maintained, and the temperature of the Cu-Ni-Sn melt is reduced to the vicinity of 1250 degrees C. It has been found beneficial to add a small amount of Mn to the melt at this point to tie up residual sulfur. It is also beneficial at this point to plunge a small amount of Mg into the melt as a predeoxidant. Amounts of Mn in the range of 0.1–0.3 percent and Mg in the range of 0.05–0.1 percent are generally adequate for such purposes, Mg being added preferably in the form of CuMg alloy. Mo, Nb, Ta, or V is now plunged into the melt, preferably as a eutectic mixture with Ni to facilitate mixing. Low melting point eutectic compositions are as follows: Ni—50 percent Nb, Ni—35 percent Ta, Ni—47 percent V, Ni—46 percent Mo.

The process described above for adding refractory metals Mo, Nb, Ta, or V to a melt of Cu, Ni, and Sn has been found to have a yield of 60–80 percent. To ensure the presence in the final alloy of a desired percentage of the refractory metal, a correspondingly greater amount of starting material has to be added initially.

The addition of Mg to the melt as called for above may result in residual amounts of Mg to be present in the alloy. Such presence does not materially diminish optimal alloy properties and is tolerable in amounts of up to 0.1 percent Mg. Mn may be tolerated in even larger amounts and may be intentionally added in amounts up to 5 percent, e.g., as a less expensive substitute for copper. Similarly, amounts of up to 5 percent Zn may replace Cu without undue degradation of alloy properties. Other impurities, such as may be present in commercially available alloy ingredients, are tolerable in amounts of up to 0.2 percent Co, 0.1 percent Al, 0.01 percent P, 0.05 percent Si, 0.005 percent Pb. Oxygen contents should be kept below 100 ppm to prevent the formation of refractory metal oxides. Combined amounts of impurities in the alloy should preferably not exceed 5 weight percent.

An article of the invention may be shaped as cast or a cast ingot may undergo processing and shaping at temperatures at or above the recrystallization temperature by means such as forging, extruding, hot working, or hot pressing. The shaped article is annealed at a temperature in a range which depends on Ni and Sn contents of the alloy as shown in Table 1 for four exemplary alloys. In general, for fixed amounts of Ni, the upper limit on anneal temperature decreases with increasing amounts of Sn and the lower limit on anneal temperature increases with increasing amounts of Sn. Conversely, for fixed amounts of Sn, both the upper and the lower limit on anneal temperature increase with increasing amounts of Ni. To prevent coarsening of the distribution, annealing temperatures are preferably chosen close to the lower limit of the permissible range as shown in Table 1 for exemplary combinations of Cu, Ni, and Sn. Moreover, as illustrated in FIG. 2, annealing times should preferably not exceed four hours. Annealing times as short as 7–20 minutes may be sufficient for small articles. Such annealing causes formation of a solid solution of the Cu-Ni-Sn component of the alloy and, simultaneously, precipitation of the additional element at the grain boundaries as well as within the matrix.

After annealing, the article is water or brine quenched (whereby an essentially isotropic grain structure as produced by annealing is essentially retained) and aged at a temperature in the range of from 300 degrees C. to 475 degrees C. An aging temperature in the range of 375°–425 degrees C. may be considered typical; however, aging temperature may be adjusted to compensate for longer or shorter aging time as may be practical depending on the size and shape of the article. Specifically, in the interest of uniform internal temperature distribution, bulky articles are preferably aged for a longer period of time while wire and strip material may be aged, e.g., in a continuous process, for a shorter period of time. An increase in aging time by a factor of ten typically corresponds to a decrease in aging temperature by about 50 degrees C. and conversely. However, aging time must not exceed approximately 475 degrees C., higher temperatures being conducive to an undesirable embrittling nucleation-and-growth transformation. It is a characteristic feature of the disclosed method that no use need be made of cold working to develop a spinodal structure and that, consequently, an article of manufacture according to the invention may be shaped as cast, forged, hot worked, hot pressed, or extruded, i.e., shaped at temperatures at or above the recrystallization temperature of the alloy and resulting in an essentially isotropic grain structure which is essentially retained upon quenching and aging. While processing involving no cold work is a preferred mode of manufacturing articles according to the invention, a step of cold working prior to aging to further shape an article by any desired amount is not precluded. The presence of an additional element selected from the group consisting of Mo, Nb, Ta, V, and Fe in the alloy has the additional beneficial effect that, in applications in which strength of the shaped article is a primary requirement, higher levels of strength are achieved for a given amount of cold work compared with strength achieved in a corresponding Cu-Ni-Sn alloy not containing such additional element. Amounts of cold work of less than 25 percent area reduction or even less than 20 percent or 15 percent area reduction are beneficial in this context.

In the event cold working is utilized, customary duplexing of cold working and aging is not precluded. Specifically, instead of terminating in sequential annealing, quenching, cold working, and aging, such treatment may terminate, e.g., in the sequential steps of annealing, quenching, cold working, aging, quenching, cold working, and aging. Still more elaborate methods are also within the scope of the invention provided they comprise, in the order stated, the steps of annealing, quenching, and aging, which order is implied throughout this disclosure.

It has been ascertained that amounts of Mo, Nb, Ta, V, or Fe which are desirable for the purpose of the invention lie within relatively narrow and well-defined ranges outside of which distinctly inferior properties are realized. Specific limits for an alloy containing 3 percent Ni are 0.02–0.07 weight percent Mo, 0.05–0.3 weight percent Nb, 0.02–0.1 weight percent Ta, 0.10–0.5 weight percent V, or 1–5 weight percent Fe. For an alloy containing 20 percent Ni, corresponding limits are 0.05–0.1 weight percent Mo, 0.08–0.35 weight percent Nb, 0.05–0.3 weight percent Ta, 0.2–0.5 weight percent V, or 2–7 weight percent Fe. For intermediary amounts of nickel, limits for Mo, Nb, Ta, and V may be obtained by linear interpolation between limits at 3 percent and at 20 percent Ni. Amounts below the given lower limits are less desirable because of insufficient precipitation of the additional element during annealing, amounts exceeding the given upper limits favor the presence of Ni-refractory intermetallics which may cause reduced ductility. For the purpose of the invention, additives Mo, Nb, Ta, V, and Fe may also be used in combination in which case at least one of them should preferably be present in an amount within the stated limits.

Examples 1 through 18 are shown in Table 2. Melts containing refractory elements Mo, Nb, Ta, or V were prepared by the method described above. Cast ingots were cold rolled by an amount of 50 percent area reduction prior to annealing, quenching, and aging. Annealing temperature was 825 degrees C. for examples 1–10, 850 degrees C. for examples 11–14, and 900 degrees C. for examples 15–18.

TABLE 1

| % Ni | % Sn | Annealing Temperature Degrees C. Range | Preferred Range |
|---|---|---|---|
| 5 | 5 | 625–975 | 650–700 |
| 5 | 8 | 675–860 | 675–750 |
| 10 | 5 | 740–975 | 750–800 |
| 10 | 9 | 825–900 | 825–850 |
| 15 | 5 | 775–975 | 775–825 |
| 15 | 10 | 820–900 | 820–850 |

TABLE 2

| No. | Alloy | Aging Temp. Degrees C. | Aging Time Hrs. | 0.01% Yield Strength psi. | Tensile Strength psi. | Elongation % |
|---|---|---|---|---|---|---|
| 1 | 15 Ni-8 Sn | 400 | 0.5 | 87,000 | 120,000 | 1.7 |
| 2 | 15 Ni-8 Sn | 400 | 2 | 104,000 | 104,000 | 0.02 |
| 3 | 15 Ni-8 Sn-.195 Nb | 400 | 1 | 124,000 | 157,000 | 14 |
| 4 | 15 Ni-8 Sn-.195 Nb | 450 | 0.25 | 135,000 | 164,000 | 6 |
| 5 | 15 Ni-8 Sn-.4 V | 400 | 2 | 130,000 | 162,000 | 9 |
| 6 | 15 Ni-8 Sn-.4 V | 400 | 7 | 140,000 | 163,000 | 4.5 |
| 7 | 15 Ni-8 Sn-.4 V | 375 | 15 | 136,000 | 164,000 | 12 |
| 8 | 15 Ni-8 Sn-.05 Ta | 400 | 1 | 122,000 | 156,000 | 6 |
| 9 | 15 Ni-8 Sn-.05 Ta | 400 | 4 | 137,000 | 157,000 | 2.5 |
| 10 | 15 Ni-8 Sn-.06 No | 400 | 2 | 120,000 | 156,000 | 6 |
| 11 | 10 Ni-8 Sn-.25 Nb | 400 | 0.2 | 116,000 | 155,000 | 15 |
| 12 | 10 Ni-8 Sn-.25 Nb | 400 | 0.5 | 135,000 | 165,000 | 4.5 |
| 13 | 10 Ni-8 Sn-.25 Nb | 350 | 3 | 134,000 | 165,000 | 7.5 |
| 14 | 10 Ni-8 Sn-.25 Nb | 300 | 17 | 123,000 | 158,000 | 15 |
| 15 | 15 Ni-8 Sn-2 Fe | 400 | 17 | 115,000 | 138,000 | 14 |
| 16 | 15 Ni-8 Sn-2 Fe | 400 | 4 | 100,000 | 137,000 | 19 |
| 17 | 10 Ni-8 Sn-2 Fe | 400 | 2 | 108,000 | 129,000 | 7 |
| 18 | 15 Ni-8 Sn-5 Fe | 400 | 17 | 101,000 | 132,000 | 10 |

What is claimed is:

1. A method for manufacturing a body of a predominantly spinodal alloy by a treatment of an initial body which, in an amount of at least 95 percent by weight, consists of Cu, Ni, Sn, and at least one additional element, Ni being present in said alloy in an amount of from 3–20 weight percent, Sn being present in said alloy in an amount of from 3.5–10 weight percent at 3 percent Ni to from 3.5–12 weight percent at 20 percent Ni, and characterized in that (1) said additional element is selected from the group consisting of Mo in an amount of 0.02–0.07 weight percent at 3 percent Ni to 0.05–0.1 weight percent at 20 percent Ni, Nb in an amount of 0.05–0.3 weight percent at 3 percent Ni to 0.08–0.35 weight percent at 20 percent Ni, Ta in an amount of 0.02–0.1 weight percent at 3 percent Ni to 0.05–0.3 weight percent at 20 percent Ni, V in an amount of 0.1–0.5 weight percent at 3 percent Ni to 0.2–0.5 weight percent at 20 percent Ni, and Fe in an amount of 1–5 weight percent at 3 percent Ni to 2–7 weight percent at 20 percent Ni, and (2) said treatment comprises the steps, carried out in the order stated, of (a) short term, low temperature annealing to form a solid solution of the Cu-Ni-Sn component of said alloy and to precipitate said additional element, (b) rapid quenching, (c) cold working in an amount of less than 25 percent area reduction, and (d) aging.

2. Method of claim 1 in which cold working is in an amount of less than 20 percent area reduction.

3. Method of claim 2 in which cold working is in an amount of less than 15 percent area reduction.

4. A method of claim 1 in which aging is at temperatures in the range of from 300° C. to 475° C.

5. Method of claim 1 in which said treatment terminates in the sequential steps of annealing, quenching, cold working, aging, quenching, cold working, and aging.

6. Method of claim 1 in which said additional element is selected from the group consisting of Mo, Nb, Ta, and V and in which said initial body is cast from a final melt which is prepared by providing a first melt of constituent elements Cu and Ni, placing a cover of dry graphite on said first melt, bubbling an inert gas through said first melt, adding constituent element Sn to said first melt to obtain a second melt of Cu, Ni, and Sn, adding to said second melt an amount of Mn in the range of from 0.1 to 0.3 weight percent and an amount of Mg in the range of from 0.05 to 0.1 weight percent to obtain a third melt, and plunging into said third melt a fourth constituent element selected from said group to obtain said final melt.

7. Method of claim 6 in which said fourth constituent element is plunged into said third melt in the form of a low melting eutectic mixture with Ni.

8. A method of claim 1 in which quenching is water quenching or brine quenching.

* * * * *

UNITED STATES PATENT AND TRADEMARK OFFICE

CERTIFICATE OF CORRECTION

PATENT NO. : 4,260,432

DATED : April 7, 1981

INVENTOR(S) : John T. Plewes

It is certified that error appears in the above—identified patent and that said Letters Patent is hereby corrected as shown below:

Column 5, line 51, "No" should read --Mo--.

Signed and Sealed this

*Fourth* Day of *August 1981*

[SEAL]

*Attest:*

GERALD J. MOSSINGHOFF

*Attesting Officer*

*Commissioner of Patents and Trademarks*